US005275006A

United States Patent [19]

McCutchen

[11] Patent Number: 5,275,006

[45] Date of Patent: Jan. 4, 1994

[54] ROTARY TWO-PHASE REFRIGERATION APPARATUS AND METHOD

[76] Inventor: Wilmot H. McCutchen, P.O.Box 701129, Houston, Tex. 77270

[21] Appl. No.: 929,287

[22] Filed: Aug. 13, 1992

[51] Int. Cl.[5] ..... F17C 7/04

[52] U.S. Cl. ..... 62/48.1; 62/68

[58] Field of Search ..... 62/68, 48.1, 48.2, 381

[56] References Cited

U.S. PATENT DOCUMENTS

| | | | |
|---|---|---|---|
| 2,448,802 | 9/1948 | Holzcker | 62/68 |
| 3,369,371 | 2/1968 | Holly et al. | 62/48.2 |
| 3,432,996 | 3/1969 | Patterson | 62/48.1 |
| 3,837,491 | 9/1974 | Humiston et al. | 202/238 |
| 5,154,062 | 10/1992 | Gaumer, Jr. et al. | 62/68 |

OTHER PUBLICATIONS

"Seawater Desalination" by R. S. Silver, in *Desalination Technology* [Porteous, Ed.] (New York: Applied Science Publishers) pp. 27–28.

*Design Theory of Fluidic Components* by Kirshner & Katz (New York: Academic Press 1975) pp. 7–9, 276–281.

*Primary Examiner*—Ronald C. Capossela

[57] ABSTRACT

Rotary vacuum evaporation of a primary refrigerant cools a secondary refrigerant mixed with it. The secondary refrigerant does not change state and meanders through a low pressure cooling circuit for refrigeration applications. The primary refrigerant changes state and remains in a short and secure circuit. Evaporation is produced at a surface around the axis of rotation and within the mixture by opposed centrifugal and centripetal forces acting through a narrow afferent mesial passage between rotating disks mounted on a hollow shaft. Vapor is stripped from the surface, scrubbed by cyclonic flow through the afferent mesial passage, and condensed by a centrifugal compressor, which is a centrifugal pump having its inlet communicating with the bore of the hollow shaft and the afferent mesial passage. Latent heat is drawn off by water, making this a water heater, and the water is produced by de-humidification. The primary refrigerant and the secondary refrigerant are cheap and environmentally harmless, e.g. propylene glycol and acetone. A method and apparatus for refrigeration using only water is disclosed. Energy efficiency is maximized by avoidance of positive displacement pumps and narrow conduits, and by operation during times when excess power is in the grid.

19 Claims, 5 Drawing Sheets

ROTARY TWO-PHASE REFRIGERATION APPARATUS AND METHOD

FIELD OF THE INVENTION

This invention relates to methods and apparatus for refrigeration and evaporative cooling of liquids.

BACKGROUND—PRIOR ART

The technology of cooling practiced most in the art is Joule-Thompson expansion, which is known to produce cooling by the forced mechanical separation of molecules in a jet. A gas or liquid under pressure is released through an expansion valve, and the attractive forces between the molecules are overcome by momentum. The flow is turbulent. This is known to be an inefficient process, but where abundant energy is available, as in jet airplane intercooling, this disadvantage is negligible.

However, for home or industrial refrigeration, energy efficiency is important. Fluids used must be easily torn apart by the Joule-Thompson expansion valve. Fluorocarbons meet this requirement, but have been found to have adverse environmental effects. Using only one phase is practiced currently in the art of vapor compression refrigeration. That phase is fluorocarbons due to their superior qualities when used in a Joule-Thompson expansion valve. However, fluorocarbons are known to be a danger to the environment and are scheduled for extinction soon. Two-phase systems known to the art are bulky brine systems and adsorption devices.

Vapor compression refrigeration cycles known to the art comprise two stages. In the first stage, vapor of the refrigerant is compressed, liberating the latent heat of the refrigerant vapor. The vapor usually is compressed to the point of condensation, although gas refrigeration cycles that do not change state are known. The condensate or compressed gas is pushed through a long conduit to engage in heat exchange with the ambient fluid, generally air, so as to discharge the latent heat from the system. The conduit is generally a narrow pipe to maximize the heat exchange surface. Friction loss from pumping liquid through a narrow pipe makes this an inefficient system.

Screw or centrifugal compressors, where compression is accomplished by centrifugal force pressing the refrigerant vapor against a wall, have been used in large applications. Centrifugal pumps are unable to produce the high head needed for pushing condensed refrigerant through the long and narrow pipe of a small refrigerator or air conditioner heat exchange section, so generally positive displacement pumps are used. The pressure in the conduit is greater than the pressure of the atmosphere so that no air or water vapor can intrude into the system. Oil from the seals of these positive displacement pumps can contaminate the refrigerant, resulting in loss of efficiency.

After its passage through the heat exchange section, the high-pressure cooled refrigerant condensate is then released through an expansion valve into another tube, beginning the second stage, which is where cooling actually takes place. The lowering of pressure allows evaporation. Evaporation draws heat from the walls of the tube, which in turn draw heat from the ambient air around the food or other item to be cooled. Once evaporated, the refrigerant is recondensed in the first stage, renewing the cycle.

Pushing condensate through long, narrow, high-pressure conduits by positive displacement pumps requires an inordinate amount of energy. Furthermore, positive displacement pumps hammer the condensate, causing constant vibration of the long, narrow, high pressure conduits, resulting in fatigue in the materials and leaks of refrigerant through cracks.

The use of CFCs (chloroflourocarbons) and other dangerous refrigerants in such vulnerable circuits is a matter of increasing concern. CFCs have been found to damage the ozone layer of the atmosphere, and the production of CFCs after the year 2000 has been banned by Title VI of the Clean Air Act Amendments of 1990, Pub. L. No. 101-549, 104 Stat. 2399 (1990). A new refrigeration method and apparatus is especially needed for automobile air conditioning units because in 1994 a phase-in is to begin that will preclude the sale of automobiles containing ozone-depleting refrigerants. 42 U.S.C. Section 7671 h.

Ammonia is used in industrial chillers. Its disadantage is that it is explosive and poisonous.

Two-phase refrigeration systems cool a fluid and then circulate that cooled fluid to engage in heat exchange with the material to be cooled. The cooled fluid is known as the secondary refrigerant. It does not change state during the refrigeration process, but merely acts as a heat exchange medium. For example, brine is used as a secondary refrigerant in ammonia refrigeration systems for making ice. The brine does not mix with ammonia and does not change state; it merely acts as a medium for drawing heat out of the water which is turned into ice.

SUMMARY OF THE PRESENT INVENTION

The evaporative cooling method disclosed herein is broad enough to allow the use of ordinary tapwater or seawater as a refrigerant. The residue would be circulated through a cooling circuit and then discharged, and the vapor would be condensed into pure water.

According to the preferred embodiment, which is a two-phase closed system, a mixture of a primary refrigerant and a secondary refrigerant is contained within a tank. The primary refrigerant, which could be a cheap and environmentally benign chemical such as ethanol or acetone, has a low specific gravity and a high vapor pressure, while the secondary refrigerant, which could also be a cheap and environmentally benign chemical, such as glycerine or propylene glycol, has a high specific gravity and a low vapor presure. The secondary refrigerant does not change state and circulates through the environment at low pressure. The primary refrigerant changes state in a small and secure circuit.

A rotating evaporator submerged in the mixture in the tank produces a surface of the mixture around an axis of rotation, and a centrifugal pump, acting in a plane approximately normal to said axis of rotation, through an afferent mesial passage, strips saturated vapor off of this surface, allowing further evaporative cooling. Passage of the vapor through the rotating afferent mesial passage scrubs entrained mist droplets from the primary refrigerant vapor. The scrubbed vapor is sucked out and condensed by the centrifugal pump acting as a centrifugal compressor in a condensation chamber, and the condensate is remixed with the secondary refrigerant, and then reintroduced into the tank.

Evaporation of the primary refrigerant in the mixture draws heat from the secondary refrigerant. Rotation of the mixture in the tank during the rotary evaporative process centrifugates the secondary refrigerant, with the cooler portions, which are more dense than the hotter portions, going out to the wall of the tank, displacing the primary refrigerant inward toward the axis of rotation to be evaporated. Cooled secondary refrigerant leaves the tank and circulates through a cooling circuit outside the tank, where it engages in heat exchange with the substance to be cooled during its meander through a wide pipe. Upon completion of the cooling circuit, the secondary refrigerant is remixed with the condensate of the primary refrigerant and then reintroduced to the tank.

Both the primary refrigerant circuit and the secondary refrigerant circuit are closed in the preferred embodiment, and the primary refrigerant does not circulate through a long and potentially leaky tube exposed to the atmosphere. Therefore, even ammonia could be used as the primary refrigerant.

Latent heat from condensation of the primary refrigerant is drawn off from the condensation chamber by heat exchange fins extending from the wall of the condensation chamber into a water jacket. Water is partially supplied by condensation on the surface of the secondary refrigerant circuit. The cooling water is either stored for use as hot water, dumped down the drain, or circulated through a heat exchange circuit to discharge the latent heat to the atmosphere.

OBJECTS AND ADVANTAGES OF THE PRESENT INVENTION

It is an object of the present invention to provide compact, safe, and energy efficient means of using cheap and harmless fluids in cooling applications in place of CFCs, HCFCs, ammonia and other noxious chemicals.

Energy efficiency is maximized because there are no positive displacement pumps hammering condensate through long and narrow tubes, with resulting friction losses and leaks. Also, the use of a secondary refrigerant allows the cooling circuit to be cooled to its maximum during times when there is excess energy in the power grid, such as at night, so that the refrigeration cycle uses cheap energy. The secondary refrigerant acts as a long-lasting heat sink, so that when air conditioning is desired, all that is necessary is that the air fans be turned on to blow air over the cooling circuit. It would not be necessary to run the refrigeration cycle during the day, since the secondary refrigerant will keep the cooling circuit cool.

It is an object of this invention to avoid switching the refrigeration cycle on and off during times when power is relatively scarce. The two-phase refrigeration apparatus described herein produces a secondary refrigerant which stays cold for a long time, acting as a buffer between the evaporative refrigeration process and the material to be cooled. Only ambient air is the buffer in home refrigerators and air conditioners, and each time the door is opened the cooled air escapes.

Another object of this invention is to avoid the waste of energy that occurs when the heat exchange portion of a refrigeration apparatus is located in a room with air conditioning. In the preferred embodiment of the present invention, water is used as a means for heat exchange, and there is the collateral benefit that refrigeration devices will serve as hot water heaters at the same time. Water may be obtained from the ambient air or from a water supply. De-humidification of the air produces condensed water vapor for use as a heat exchange fluid for the transfer of latent heat out of the system, so a refrigeration unit in a room would not create hot air for the air conditioner to cool.

Another advantage of the present invention is that the primary refrigerant is contained in a short and secure circuit, in contrast to the prior art of vapor compression refrigeration units. The primary refrigerant might be an environmentally benign and cheap fluid, such as acetone or ethanol. The only chemical which circulates through the environment is the secondary refrigerant, which is also a cheap and environmentally benign chemical such as glycerine or propylene glycol, and it circulates in a low pressure circuit with wide conduits. Friction losses from flow through narrow pipes are avoided.

DETAILED DESCRIPTION OF THE DRAWINGS

Figure 1:
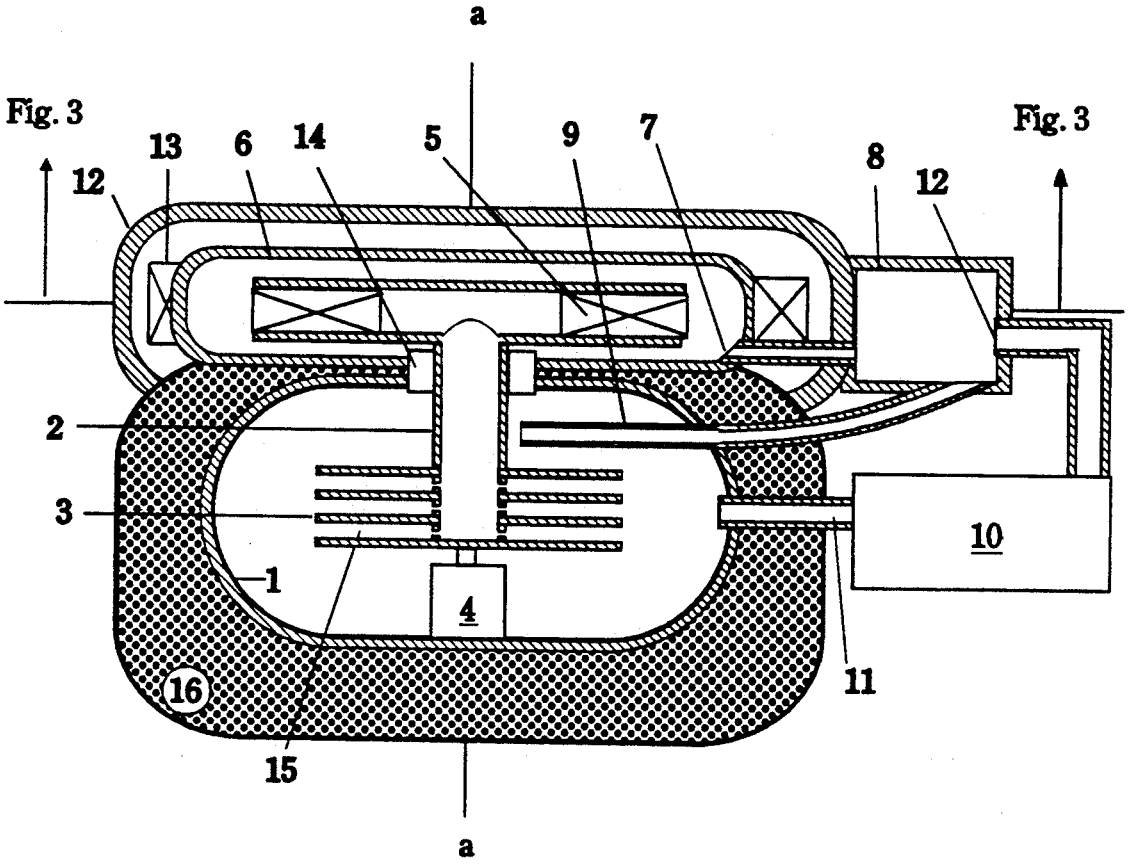
FIG. 1 shows a cross-section of the preferred embodiment of a two-phase rotary refrigeration system using the new refrigeration method of this invention.

FIG. 1 shows a cross-section of the preferred embodiment of a two-phase rotary refrigeration system using the new refrigeration method of this invention.

A tank (1) contains a liquid mixture of a primary refrigerant and a secondary refrigerant. The secondary refrigerant is propylene glycol, and the primary refrigerant is acetone. A hollow shaft (2) extends into the tank along an axis of rotation (a—a) which lies along the centerline of the hollow shaft. A seal (14) engages the hollow shaft (2) and the wall of the tank (1) so as to prevent leakage from the interior of the tank to the condensation chamber. The seal is a mechanical seal of suitable design, of which many different kinds are known to the art.

Rotatable radial structures (3) are connected to the hollow shaft and submerged in the mixture. The radial structures are rotatable about the axis of rotation (a—a), and are turned by a motor (4). The radial structures (3) comprise at least one afferent mesial passage (15) for vapor of the primary refrigerant. By the term afferent mesial passage is meant a space extending from an inlet thereof, which is distal to the axis of rotation, to the bore of the hollow shaft (2), and extending between surfaces of the radial structures (3). The afferent mesial passage (15) communicates with the mixture or vapor thereof and with the bore of the hollow shaft. In this embodiment there are three afferent mesial passages, each disposed in a plane approximately normal to the axis of rotation (a—a). These three afferent mesial passages are defined by the four radial disks (3) attached to the hollow shaft.

Also attached to the hollow shaft and turned by the motor (4) is a centrifugal pump (5) outside the tank (1). The bore of the hollow shaft communicates with the intake ofthe centrifugal pump, so the centrifugal pump communicates with the afferent mesial passage (15) through the hollow shaft. The centrifugal pump (5) is contained within a condensation chamber (6), so that the output of the centrifugal pump is pressed against the wall of the condensation chamber (6), providing means for condensing vapor of the primary refrigerant to form a condensate. Heat exchange fins (13) extend from the condensation chamber into a heat exchange chamber (12) which is filled with heat exchange fluid, such as water. Water condensing on the cooling circuit (10) is collected and introduced to the heat exchange chamber by suitable means, not shown, which would be obvious to those skilled in the art. The latent heat released upon condensation of primary refrigerant vapor is transferred into the heat exchange fluid, and this heat is discharged from the system by draining the heat exchange fluid from the heat exchange chamber (12). The heat exchange fluid could also be cooled by its own heat exchange circuit (not shown) such as an automobile radiator or other designs known to the art. Water from the heat exchange chamber may be stored for dishwashing or other uses. Insualtion (16) separates the tank from the condensation chamber (6) and heat exchange chamber (12), preventing latent heat from entering the tank.

Condensate of the primary refrigerant exits the condensation chamber through a one-way valve in the condensate port (7) and mixes with the secondary refrigerant in a mixing chamber (8). Preferably, the flow of condensate is tangential. The flow of condensate from the condensation chamber is produced by the centrifugal pump. When the centrifugal pump is not in operation, or when the pressure of the condensate is insufficient to overcome the pressure within the mixing chamber and allow condensate to flow in, the one-way valve prevents fluid flow from the mixing chamber into the condensation chamber. The mixture thus produced in the mixing chamber (8) flows through an inlet tube (9) into the tank, preferably to a point near the hollow shaft.

A cooling circuit (10) communicates with the tank through the secondary refrigerant port (11) and with the mixing chamber (8) through the secondary refrigerant inlet (12). Cool secondary refrigerant exits the tank, impelled by the centrifugal force imparted to the mixture by the rotation of the radial structures (3). Additionally, the cooling circuit could have its own pump (not shown) of suitable design known to the art. The conduit in the cooling circuit is of cooper or other suitable heat exchange material known to the art. The cooling circuit circulates cooled secondary refrigerant and acts as a heat sink for the material to be cooled. For application as an air conditioner, ambient air is blown over the meanders of the cooling circuit, and condensate from the air drips from the cooling circuit and is introduced to the heat exchange chamber (12) to cool the condensation chamber (6).

Rotation of the radial structures (3) causes a vortex in the mixture about the axis of rotation (a—a) and in the plane of the afferent mesial passage (15). The mixture is impressed with a centrifugal force due to this vortex. The mixture is also impressed with a simultaneous centripetal force in the plane of the afferent mesial passage (15) due to the rotation of the centrifugal pump (5). Between these two opposed forces, the pressure of the mixture is lowered to the vapor pressure of the primary refrigerant, and the mixture cavitates, forming a surface around the axis of rotation (a—a). The action of the centrifugal pump strips saturated vapor from that surface, thereby allowing evaporation to continue at that surface.

There are two closed circuits for the circulation of the refrigerants, and these circuits converge in the mixing chamber (8), the inlet tube (9), and the tank (1). Mixture allows for heat exchange between the primary refrigerant and the secondary refrigerant. Heat is transferred to the primary refrigerant from the material to be cooled through the secondary refrigerant.

The secondary refrigerant circuit comprises the secondary refrigerant port (11), the cooling circuit (10), the refrigerant inlet (12), the mixing chamber (8), and the inlet tube (9). Additional pumps could be added for the secondary refrigerant, but the pressure caused by centrifugal force within the tank is sufficient to cause the secondary refrigerant to flow if it does not have to overcome a large resistance. Wide conduits for the secondary refrigerant in the cooling circuit improve flow by lessening friction losses. Heating of the secondary refrigerant at the wall of the conduits of the cooling circuit by heat exchange with the material to be cooled would also aid circulation through the secondary refrigerant circuit. Fans (not shown) blowing air over the secondary refrigerant conduits in the cooling circuit (10) provide cool air. When cool air is no longer desired, the fans are switched off. Although the fans are switched off, the cooling circuit remains cool and immediately available for air-conditioning. The refrigeration apparatus per se is not switched on and off as cooling is desired; the secondary refrigerant provides a buffer for storage of coolness produced during times of low power demand in the power grid, and the motor (4) which produces refrigeration need not be turned on when the cooling circuit (10) is being used.

The primary refrigerant circuit comprises means for compressing vapor, means for evaporating the mixture, means for discharging latent heat, and means for introducing condensate of the primary refrigerant into the tank.

Means for compressing vapor are provided by the condensation chamber (6) and the centrifugal pump (5). Means for evaporating the mixture are provided by: the hollow shaft (2), its attached rotatable radial structures (3), the afferent mesial passage (15) defined between the radial structures, and the means for pumping fluid through the afferent mesial passage and through the hollow shaft to the means for compressing vapor, i.e. the centrifugal pump (5). Means for discharging latent heat are provided by the centrifugal pump (5), the condensation chamber (6), the heat exchange fins (13), and fluid within the heat exchange chamber (12). Means for introducing condensate of the primary refrigerant into the tank are provided by the condensate port (7), the mixing chamber (8), and the inlet tube (9).

Fluid flow within the primary refrigerant circuit and the secondary refrigerant circuit is caused by the motor (4) rotating the radial structures (3) and the centrifugal pump (5).

Figure 2:
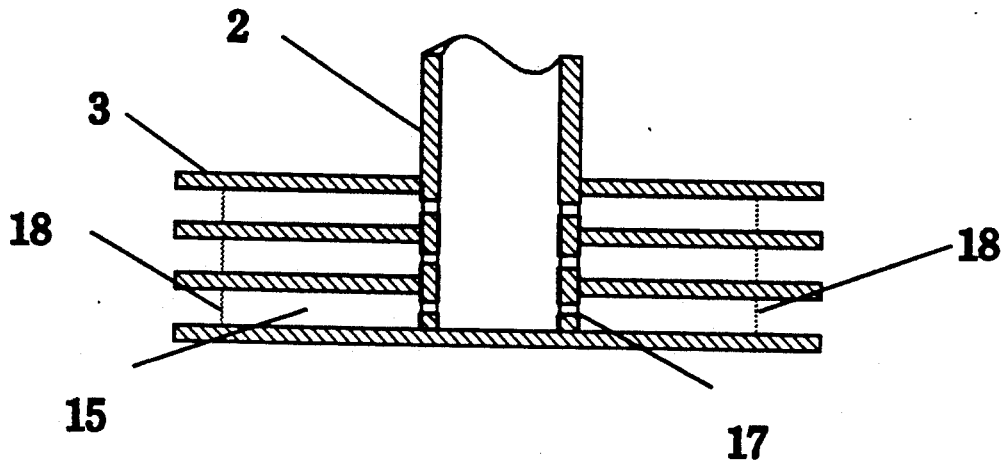
FIG. 2 shows a detail of the radial structure of the preferred embodiment.

FIG. 2 shows a detail of the radial structures of the preferred embodiment shown in FIG. 1. Four approximately parallel and spaced apart disks are attached normal to the hollow shaft. An afferent mesial passage (15) is defined by and between each pair of disks. Holes (17) in the wall of the hollow shaft (2) allow communication between the mixture (18) and the bore of the hollow shaft. Vapor coming from the surface of the mixture (18) is scrubbed by vacuum-induced cyclonic flow through the afferent mesial passage (15) and by its greater centrifugal force in rotation about the axis of rotation (a—a). The axes of the cyclones are approximately in the plane of the afferent mesial passage, and are caused by the vacuum drawn through the holes during rotation. The entrained mist droplets, being denser than the primary refrigerant vapor, are centrifugated by the cyclones to the surface of the disks of the radial structures (3), and the rotation of the disks imparts additional centrifugal force in a direction normal to the axis of rotation (a—a), flinging the droplets back into the mixture. Scrubbed vapor proceeds through the holes (17) and through the hollow shaft to the condensation chamber (6) (not shown in this drawing, see FIG. 1 and FIG. 3).

Figure 3:
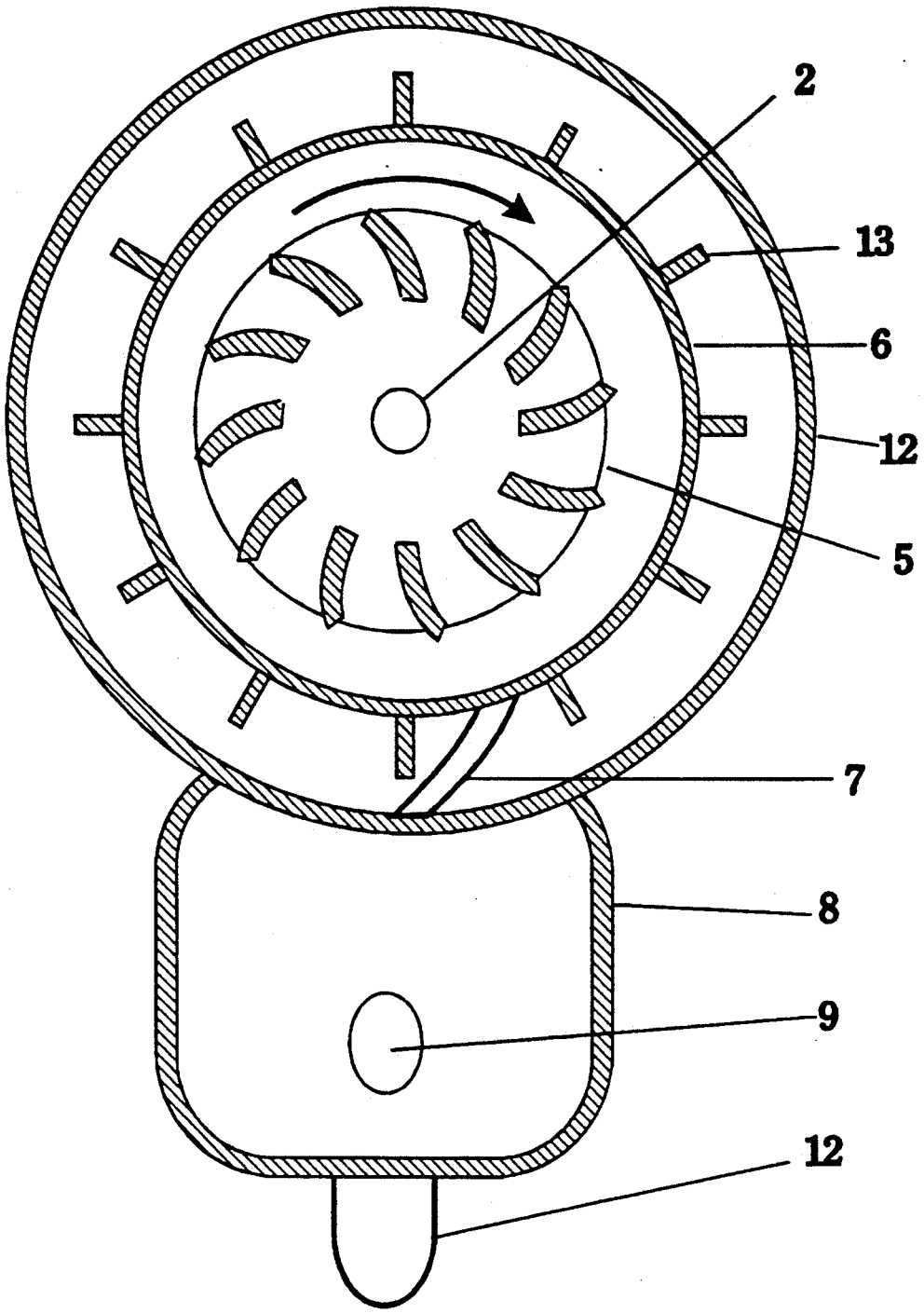
FIG. 3 shows a top view of the preferred embodiment along the section shown in FIG. 1.

FIG. 3 shows a top view along the section shown in FIG. 1.

Figure 4:
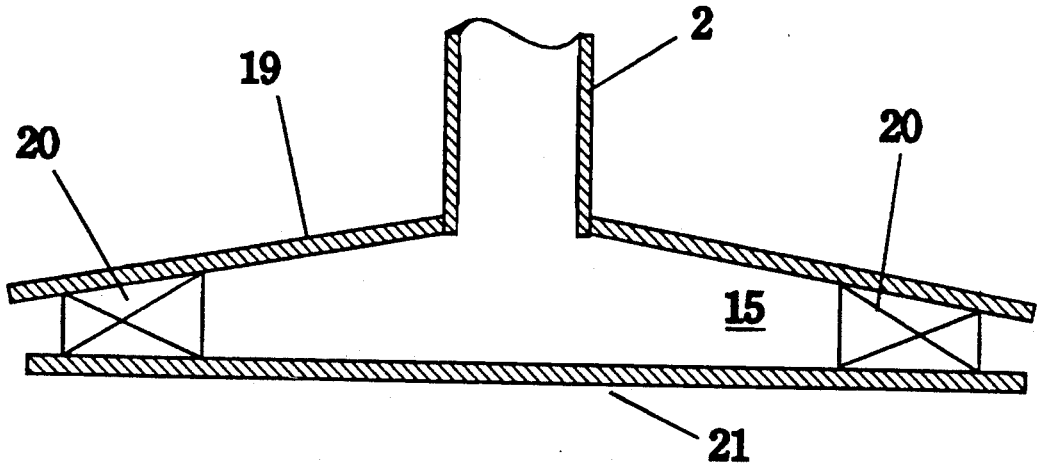
FIG. 4 shows an alternative embodiment of the radial structures, comprising a conical radial element and a planar radial element, connected by impeller vanes in the afferent mesial passage.

FIG. 4 shows an alternative embodiment of the radial structures, comprising a conical radial element and a planar radial element, connected by impeller vanes. A conical radial element (19) maintains a constant pressure as vapor flows to the bore of the hollow shaft, thereby avoiding condensation of saturated vapor in the afferent mesial passage (15). Impeller vanes (20) connect the conical radial element (19) to a planar radial element (21) and impart additional centrifugal force to the mixture in the plane of the afferent mesial passage (15). The centrifugal pump (not shown) in the condensation chamber (not shown) draws fluid through the afferent mesial passage (15) between the conical radial element (19) and the planar radial element (21) against the centrifugal force of the mixture. The planar radial element connects to the motor (not shown) which rotates the radial structures.

Figure 5:
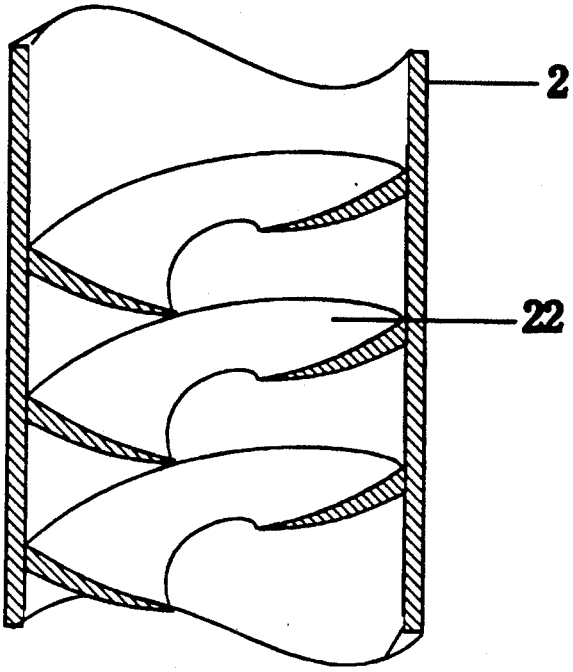
FIG. 5 shows an alternative embodiment of the hollow shaft, comprising a turbine within its bore.

FIG. 5 shows an alternative embodiment of the hollow shaft, comprising a turbine (22) disposed within its bore. The rotation of the shaft rotates the turbine, but the turbine could also be separately driven. The work of the turbine draws vapor away from the surface of the mixture (not shown) and compresses it in the condensation chamber (not shown). The turbine could be used in addition to or in lieu of the centrifugal pump within the condensation chamber (not shown, see FIG. 1).

Figure 6:
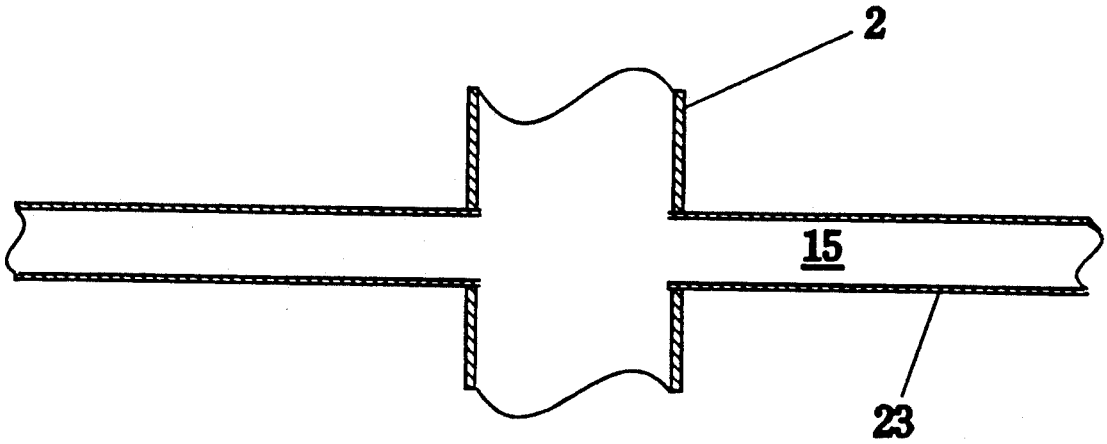
FIG. 6 shows a cross section of an alternative embodiment of the rotatable radial structures, comprising tubes rather than planar radial elements.

FIG. 6 shows an alternative embodiment of the rotatable radial structures, comprising tubes rather than planar radial elements. The afferent mesial passage (15) is through tubular rotatable radial structures (23). The tubes curve away from the direction of rotation.

Figure 7:
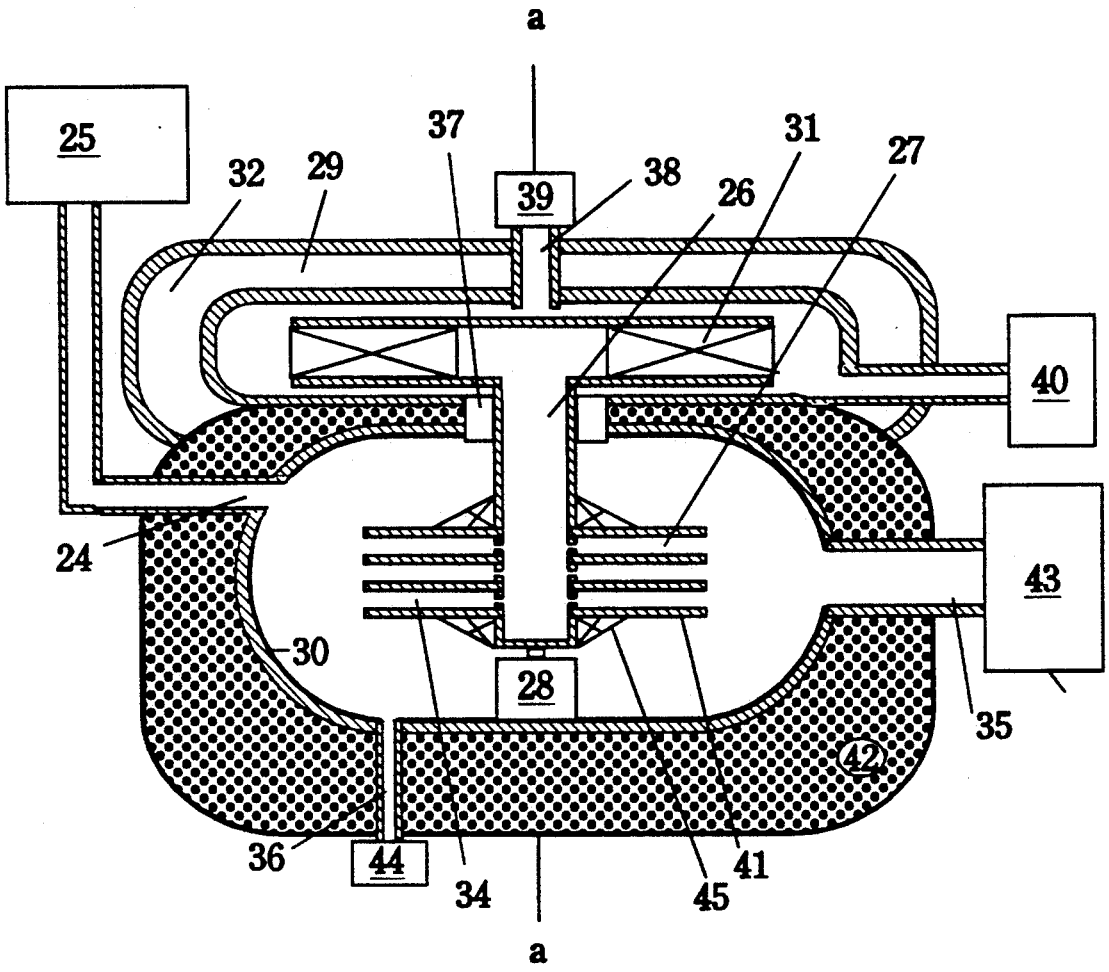
FIG. 7 shows a cross section of a rotary refrigeration device using water as a primary refrigerant and brine as a secondary refrigerant, and having open primary refrigerant and secondary refrigerant circuits.

FIG. 7 shows a rotary refrigerator using water as the primary refrigerant and residue from evaporation as the secondary refrigerant. Water enters through a distilland inlet port (24) and proceeds into a distilland tank (30) through a channel (25). A hollow shaft (26) disposed within the channel (25) and the tank (30) connects a vapor pump (31) and a distilland pump (27), and a motor (28) rotates the distilland pump and the vapor pump. The distilland pump (27) comprises approximately parallel and spaced apart disks (41) preferably having attached efferent impellers (45) and defining therebetween an afferent mesial passage (34). The afferent mesial passage (34) communicates with a condensation chamber (29) through the vapor pump (31) and the bore of the hollow shaft (26). The condensation chamber (29) encloses the vapor pump and engages with the hollow shaft (26) at the shaft seal (37), which is a mechanical seal of which many different kinds are known to the art. At the top of the condensation chamber and at its center is a gas vent (38) through which evolved noncondensable gases are withdrawn from the condensation chamber to processing by suitable means (39). A distillate outlet (40) provides means for withdrawing condensate from the system. A heat exchange chamber (32) adjacent to the condensation chamber (29) but separated from the tank (30) by insulation (42), provides means for discharging the latent heat liberated by condensation of vapor. The heat exchange chamber contains water and is cooled by suitable means (not shown).

Any solids in the distilland are centrifugated out to the wall of the tank by the rotation of the distilland pump, and settle at the bottom of the tank where they are periodically discharged through a solids purge (36) through the tank monitored and controlled by suitable means (44). A residue port (35) through the tank (30) below the distilland pump provides means for withdrawing cooled liquid residue, such as brine, for cooling applications in a cooling circuit (43). After circulation through the cooling circuit, the residue is discharged from the system. Both the products of condensation and the residue from evaporation are discharged from the system, and a continuous feed of distilland is required. A byproduct of this cooling device is pure distilled water.

The rotation of the vapor pump (31), which is a centrifugal pump, of which many different designs are known to the art, draws a vacuum in the bore of the hollow shaft because the hollow shaft connects to the inlet of the vapor pump. The afferent mesial passage communicates with the bore of the hollow shaft. The rotation of the distilland pump (27) impels distilland efferently in a vortex around the axis of rotation (a—a) in the plane of the afferent mesial passage, which plane is approximately normal to the axis of rotation (a—a). The work of the vapor pump (31) acting through the afferent mesial passage (34) impels the distilland afferently toward the axis of rotation. Between these two opposite forces, the distilland cavitates and forms a distilland surface (33) around the axis of rotation (a—a). Saturated vapor is continuously stripped from the distilland surface by the vapor pump (31), thus allowing further evaporation at the distilland surface. Evaporation at the distilland surface (33) by this vacuum distillation process produces cooling of the residue.

Vapor is scrubbed of any entrained mist by cyclonic flow in the afferent mesial passage (34). One vortex of the vapor is co-axial with the axis of rotation (a—a), and in this vortex mist droplets, which are more dense than vapor, are centrifugated outwards and back into the distilland. Additional vortices having an axis of rotation in a plane approximately normal to the axis of rotation (a—a) form in the afferent mesial passage due to the suction of the vapor pump through the shaft as the distilland pump rotates. The disks (41) of the distilland pump are spaced apart a distance less than their radius, so the afferent mesial passage (34) presents a narrow space for vapor to flow through. Vortices within this space impel mist droplets against the disks, and the disks impart additional angular velocity to the droplets, flinging them outward away from the axis of rotation (a—a) back into the distilland.

Vapor is separated from noncondensable gases in the condensation chamber because condensing vapor displaces noncondensable gases toward the center and out of the gas vent (38) due to the difference in density in the vortex caused by the vapor pump in the condensation chamber. Condensation of vapor creates a vacuum which aids in drawing more vapor up the shaft. The only contaminants in the condensate, i.e. distillate, would be chemicals with a vapor pressure close to that of water. Cascading such vacuum distillation devices would separate the condensate further.

OPERATION, RAMIFICATIONS, AND SCOPE

Tapwater or seawater could be used as a refrigerant by the evaporative cooling method and apparatus described herein; the residue remaining after evaporation would be cool and could be circulated through a cooling circuit and then discharged, while the vapor could be condensed and drawn off for consumption. Evaporation by opposed centrifugal and centripetal forces, with concurrent vapor scrubbing in an afferent mesial passage, assures energy efficiency.

The closed circuit, two-phase method and apparatus described herein is energy efficient and compact for cooling applications in the home, as in home refrigerators and air conditioners. Leaks of refrigerant will be avoided. The motor need not be turned on during refrigeration applications because the apparatus and method uses a buffer in heat exchange with the material to be cooled, which buffer is the cool secondary refrigerant in the meanders of the cooling circuit. Once the cooling circuit is charged with coolant, the work of the motor could be reduced to the minimum needed for maintaining a slow flow of cool secondary refrigerant into the cooling circuit to compensate for heating by the environment. Thus the rotary two-phase refrigeration device disclosed herein could run during the night, at times when power is plentiful in the grid, to charge up the cooling circuit, and then run on less energy during the day in a maintenance mode.

Energy efficiency is maximized through the use of a centrifugal pump rather than a positive displacement pump.

Evaporative cooling of a two-phase mixture is produced by a new method. A controlled bubble of cavitation is formed within the mixture by opposed afferent and efferent forces, and saturated vapor is continuously stripped from the surface of this bubble by the work of the centrifugal pump acting through the hollow shaft and the afferent mesial passage. Any mist entrained in this vapor is scrubbed by flow through the afferent mesial passage into the bore of the hollow shaft, so the work of the centrifugal pump compresses pure vapor of the primary refrigerant. Condensation of the primary refrigerant liberates latent heat, which is withdrawn from the system by the fluid in the heat exchange chamber. Evaporation of the primary refrigerant in the tank by the above-described method cools the mixture. The secondary refrigerant in the mixture is centrifugated away from the axis of rotation and goes to the wall of the tank as a cool fluid. Centrifugation of the secondary refrigerant also displaces primary refrigerant in the mixture inward for evaporation, because of the difference in their specific gravities. Circulation of secondary refrigerant through a meandering cooling circuit creates a heat sink for the material to be cooled. The heat withdrawn from that material is transported back to the tank by the secondary refrigerant, and is withdrawn from the tank by the vapor of the primary refrigerant and then discharged through the foregoing means for heat exchange. A byproduct of this heat exchange means would be hot water for use in dishwashing, bathing, or other applications.

The rotary refrigeration device described above under the discussion of FIG. 7 is a vacuum distillation device as well as a refrigeration device. It embodies two new methods of fluid separation: evaporation by opposed afferent and efferent forces, and cyclonic scrubbing of vapor or gas in an afferent mesial passage. Propylene glycol is a good secondary refrigerant because it is harmless to the environment and stays liquid over a wide range of temperatures. Its viscosity at 0° C. would be approximately that of 30 weight motor oil, and in the wide conduit of the cooling circuit it would easily flow. Its specific gravity is higher than water.

Acetone does not attack Teflon seals and stays liquid at low temperatures, down to −94° C. Its vapor pressure at 20° C. is 181 mm Hg, and at −20° C. it is 20 mm Hg, which makes it easier to evaporate than water. Its specific gravity is lower than water. Therefore, a mixture of acetone and propylene glycol will readily separate in rotation, with the acetone going to the center where it is evaporated, and the propylene glycol going to the tank wall where it enters the cooling circuit. The disadvantage of acetone is its flammability, but since the circuit of the primary refrigerant is securely contained, and does not go through the environment, this danger is minimized.

A mixture of water and a propylene glycol product called Dow Frost TM (propylene glycol plus anti-corrosion additives) would also be a good mixture for applications not requiring extreme chilling and where safety is important.

Those skilled in the art upon reading the above detailed description of the present invention will appreciate that many modifications of the method and apparatus described above can be made without departing from the spirit of this invention. All such modifications which fall within the scope of the appended claims are intended to be covered thereby.

TABLE OF DRAWING REFERENCES

1—Tank.
2—Hollow shaft.
3—Radial structures.
4—Motor.
5—Centrifugal pump.
6—Condensation chamber.
7—Condensate port.
8—Mixing chamber.
9—Inlet tube.
10—Cooling circuit.
11—Secondary refrigerant port.
12—Secondary refrigerant inlet.
13—Heat exchange fins.
14—Seal.
15—Afferent mesial passage.
16—Insulation.
17—Holes in shaft.
18—Surface of the mixture.
19—Conical radial element.
20—Impeller vanes.
21—Planar radial element.
22—Turbine.
23—Tubular rotatable radial structures.
24—Distilland inlet port.

25—Channel.
26—Hollow shaft.
27—Distilland pump.
28—Motor.
29—Condensation chamber.
30—Distilland tank.
31—Vapor pump.
32—Heat exchange chamber.
33—Distilland surface.
34—Afferent mesial passage.
35—Residue port.
36—Solids purge.
37—Shaft seal.
38—Gas vent.
39—Means for monitoring and controlling discharge of non-condensable gases through the gas vent.
40—Distillate outlet.
41—Parallel and spaced apart disks.
42—Insulation.
43—Cooling circuit.
44—Means for monitoring and controlling discharge of solids through the solids purge.
45—Efferent impellers.

I claim:

1. A two phase rotary refrigeration apparatus, comprising a tank containing a liquid mixture comprising a primary refrigerant and a secondary refrigerant;

a closed secondary refrigerant circuit outside the tank and communicating therewith; and a closed primary refrigerant circuit, comprising means for condensing vapor of the primary refrigerant, means for heat exchange connected to said vapor condensing means, means for reintroducing condensate of the primary refrigerant into the tank, and means for separating the primary refrigerant from the mixture, said separation means comprising at least one rotatable radial structure submerged in the mixture, said rotatable radial structure being rotatable about an axis of rotation and defining at least one afferent mesial passage for the flow of fluid from the mixture toward the axis of rotation, said afferent mesial passage being at least partially disposed in a plane approximately normal to the axis of rotation and having a length greater than its width, a hollow shaft having its bore communicating with the afferent mesial passage and having its centerline lying approximately along the axis of rotation, and means for pumping vapor of the primary refrigerant from the mixture through the bore of the shaft and to said condensing means while the rotatable radial structure rotates about the axis of rotation.

2. The apparatus of claim 1, wherein said condensing means comprises a centrifugal compressor.

3. The apparatus of claim 1, wherein said vapor pumping means comprises a centrifugal pump having its inlet communicating with the bore of the hollow shaft.

4. The apparatus of claim 1, wherein said vapor pumping means comprises a turbine within the bore of the hollow shaft.

5. The apparatus of claim 1, also including a mixing chamber for producing a mixture of condensate of the primary refrigerant and secondary refrigerant exiting the cooling circuit, and means connected thereto for introducing said mixture into the tank.

6. Apparatus for evaporative cooling of a liquid, comprising:

at least one rotatable radial structure disposed within in the liquid, said rotatable radial structure being rotatable about an axis of rotation and defining at least one afferent mesial passage therein allowing for the flow of vapor therethrough from the liquid toward the axis of rotation, said afferent mesial passage being at least partially disposed in a plane not parallel to the axis of rotation; and mechanical vapor flow inducing means for drawing a vacuum at the axis of rotation while the rotating radial structure rotates about the axis of rotation, said mechanical vapor flow inducing means comprising a pump having its inlet communicating with the afferent mesial passage.

7. The apparatus of claim 6, also including means for condensing vapor communicating with the outlet of the pump.

8. The apparatus of claim 7, also including means for heat exchange connected to the means for condensing vapor.

9. The apparatus of claim 7, wherein the means for condensing vapor comprises a centrifugal compressor.

10. The apparatus of claim 7, also including means for reintroducing condensate from the means for condensing vapor back into the liquid.

11. The apparatus of claim 6, also including means for flowing residue through a cooling circuit.

12. The apparatus of claim 6, also including means for separating evolved non-condensable gases from condensate from the means for condensing vapor.

13. The apparatus of claim 6, wherein the rotatable radial structure comprises at least one tube having a long axis disposed in a plane not parallel to the axis of rotation for at least part of its length.

14. The apparatus of claim 6, wherein the rotatable radial structure comprises at least two spaced-apart and approximately parallel disks disposed in planes not parallel to the axis of rotation.

15. The apparatus of claim 6, wherein the rotatable radial structure comprises at least one approximately conical cross-section.

16. The apparatus of claim 6, wherein the rotatable radial structure comprises efferent impellers.

17. The apparatus of claim 6, wherein the mechanical vapor flow inducing means comprises a centrifugal pump having its inlet communicating with the bore of a hollow shaft, the bore communicating with the afferent mesial passage.

18. The apparatus of claim 6, wherein the mechanical vapor flow inducing means comprises impellers disposed within a hollow shaft disposed along the axis of rotation, said hollow shaft having a bore communicating with the afferent mesial passage.

19. A method of evaporative cooling of a liquid, comprising the steps of rotating the liquid about an axis of rotation so as to cause a centrifugal force in the liquid, while simultaneously pumping fluid toward the axis of rotation and through means defining an afferent mesial passage disposed in the liquid so as to cause evaporation by opposed centrifugal and centripetal forces, the afferent mesial passage being at least partially in a plane not parallel to the axis of rotation, while simultaneously pumping vapor from the liquid through the afferent mesial passage and out of the liquid along the axis of rotation.

* * * * *